US005473783A

United States Patent [19]

Allen

[11] Patent Number: 5,473,783

[45] Date of Patent: Dec. 12, 1995

[54] AIR PERCOLATING PAD

[76] Inventor: Randall W. Allen, 3318 Enfield Ave., Elko, Nev. 89801

[21] Appl. No.: 222,431

[22] Filed: Apr. 4, 1994

[51] Int. Cl.[6] ..... A47C 21/04

[52] U.S. Cl. ..... 5/469; 5/423; 5/490

[58] Field of Search ..... 5/423, 469, 453, 5/456, 490; 297/180.11, 180.13; 607/104, 107; 62/261

[56] References Cited

U.S. PATENT DOCUMENTS

| | | | |
|---|---|---|---|
| 2,158,801 | 5/1939 | Petterson | 297/180.13 |
| 3,486,177 | 12/1969 | Marshack | 5/469 |
| 3,757,366 | 9/1973 | Sacher | 5/423 |
| 3,778,851 | 12/1973 | Howorth | 5/423 |
| 4,867,230 | 9/1989 | Voss | 5/423 |

FOREIGN PATENT DOCUMENTS

| | | | |
|---|---|---|---|
| 2022608 | 11/1971 | Germany | 5/469 |
| 412735 | 7/1934 | United Kingdom | 5/469 |
| 2065465 | 7/1981 | United Kingdom | 5/423 |

*Primary Examiner*—Alexander Grosz

[57] ABSTRACT

A simplified device to provide air circulation under bed-ridden patients which comprises a small thin flexible plastic pad having a plurality of flexible plastic tubes embedded or encased therein, said tubes comprising a distributer tubing and a plurality of closed end discharge tubes feeding off therefrom. The discharge tubes all contain a plurality of upwardly extending openings therein, while the distributer tubing is connected to a source of low pressure air. In use, the pad, covered with a replaceable, sterile mesh fabric cover is placed under a patient and air is forced out of said openings to circulate under the patient minimizing the formation of bed sores on such patients.

1 Claim, 2 Drawing Sheets

AIR PERCOLATING PAD

BACKGROUND OF THE INVENTION

1. Field of the Invention

The present invention relates to an air pad and more particularly pertains to such a pad which is utilized to circulate air under a bed-ridden patient to minimize bed sores.

2. Description of the Prior Art

The use of air pad for circulating air under patients is known in the prior art. More specifically, such units heretofore devised and utilized for the purpose of helping bed-ridden patients are known to consist basically of familiar, expected and obvious structural configurations, notwithstanding the myriad of designs encompassed by the crowded prior art which have been developed for the fulfillment of countless objectives and requirements. Generally such units have been primarily used for padding, i.e. air mattresses such as that shown in U.S. Pat. Nos. 5,168,589. Such mattresses are expensive and complicated, thus placing them out of the reach of most individuals and limiting their use to institutions. Other means for minimizing bed sores include differentially inflated air cushions, e.g. U.S. Pat. Nos. 3,462,775; 5,109,560 and 4,799,276. Likewise, other types of foam pads such as shown in U.S. Pat. No. 5,179,742 have been used.

In this respect, the pad according to the present invention substantially departs from the conventional concepts and designs of the prior art, and in so doing provides an apparatus primarily developed for the purpose of economically providing means to alleviate bed sores.

Therefore, it can be appreciated that there exists a continuing need for new and improved pads which can be economically used for patient treatment. In this regard, the present invention substantially fulfills this need.

SUMMARY OF THE INVENTION

In view of the foregoing disadvantages inherent in the known types of patient treatment pads now present in the prior art, the present invention provides an improved pad construction wherein the same can be utilized by an average person in an economical manner. As such, the general purpose of the present invention, which will be described subsequently in greater detail, is to provide a new apparatus which has many of the advantages of the devices mentioned heretofore and many novel features that result in an air percolating pad which is not anticipated, rendered obvious, suggested, or even implied by any of the prior art devices, either alone or in any combination thereof.

To attain this, the present invention essentially relates to a simplified device to provide air circulation under bed-ridden patients which comprises a small thin flexible plastic pad having a plurality of flexible plastic tubes embedded or encased therein, said tubes comprising a distributer tubing and a plurality of closed end discharge tubes feeding off therefrom. The discharge tubes all contain a plurality of upwardly extending openings therein, while the distributer tubing is connected to a source of low pressure air. In use, the pad, covered with a replaceable, sterile mesh fabric cover is placed under a patient and air is forced out of said openings to circulate under the patient minimizing the formation of bed sores on such patients.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new patient treating pad which has many of the advantages of the devices mentioned heretofore and many novel features that result in an air percolating pad which is not anticipated, rendered obvious, suggested, or even implied by any of the prior art devices, either alone or in any combination thereof.

It is another object of the present invention to provide a new and improved air percolating pad which may be easily and efficiently manufactured and marketed.

It is a further object of the present invention to provide a new and improved air percolating pad which is of a durable and reliable construction.

An even further object of the present invention is to provide a new and improved air percolating pad which is susceptible of a low cost of manufacture with regard to both materials and labor, and which accordingly is then susceptible of low prices of sale to the consuming public, thereby making such pads economically available to the buying public.

Still yet another object of the present invention is to provide a new and improved patient treatment pads which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
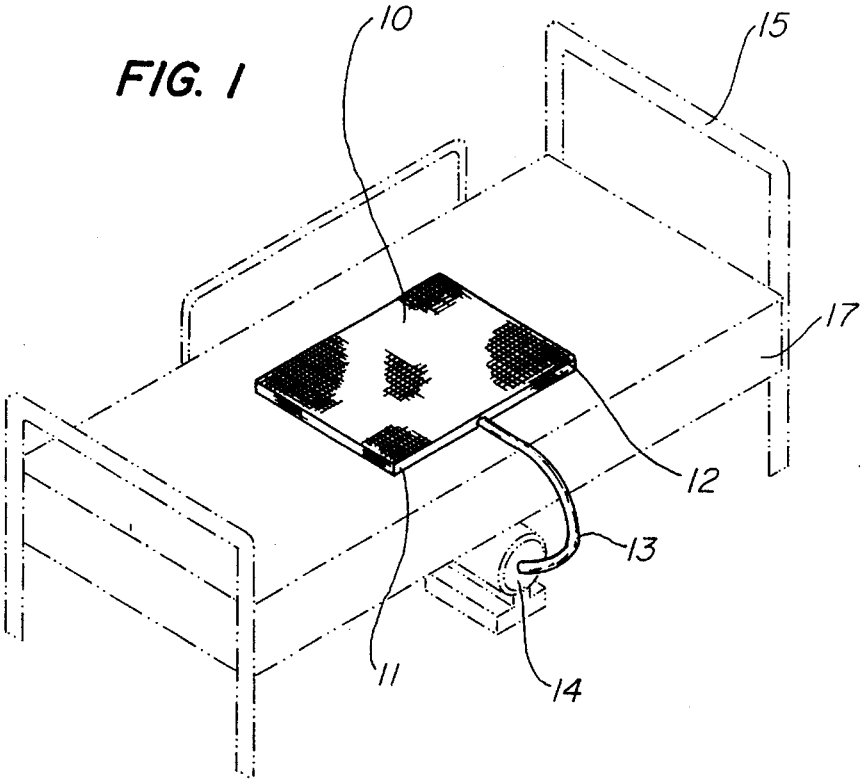
FIG. 1 is a perspective view of the present invention in place on a bed.

With reference now to the drawings, and in particular to FIG. 1 thereof, a new and improved patient treatment pad embodying the principles and concepts of the present invention and generally designated by the reference numeral 10 will be described.

More specifically, it will be noted that the present invention 10 comprises a small, thin pad 11 encased in a replaceable, sterile mesh fabric cover 12. Extending from the pad 11 is a small diameter flexible air tube 13 adapted to connect to a source of low air pressure (here shown as a small rotary air compressor 14, illustrated in broken lines). The pad 11 is placed on a bed 15 (shown in broken lines) where it underlies a patient in such bed (not shown).

Figure 2:
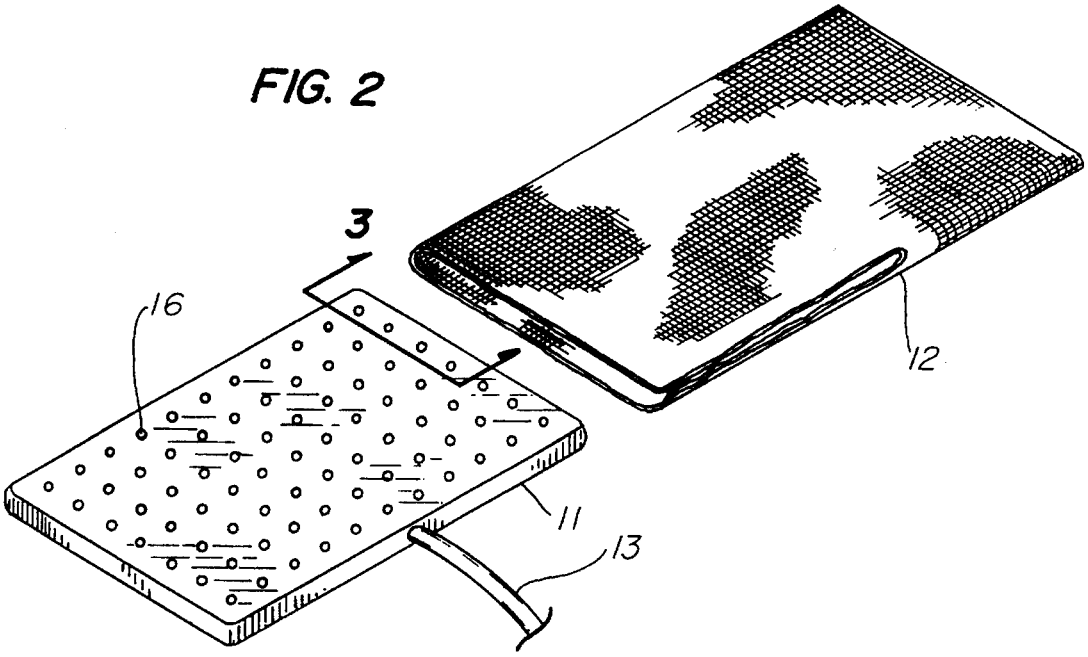
FIG. 2 is a perspective view of the pad of the present invention with the fabric cover removed.

FIG. 2 shows a detail view of pad 11 with the fabric cover 12 removed exposing the air vent holes 16 through which air flows, as shown below, to provide air circulation under the patient. It will be noted that pad 11 is very thin and provides essentially no support for a patient thereon in contrast to an air mattress type device. Support for the patient comes from the bed mattress 17. This permits a low cost but effective air circulation system.

Figure 3:
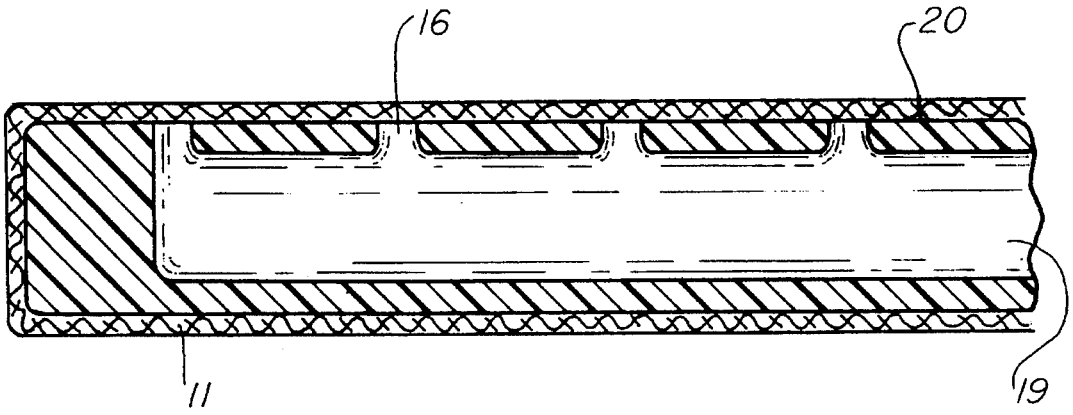
FIG. 3 is a cross-section taken on line 3—3 of FIG. 2.
Figure 4:
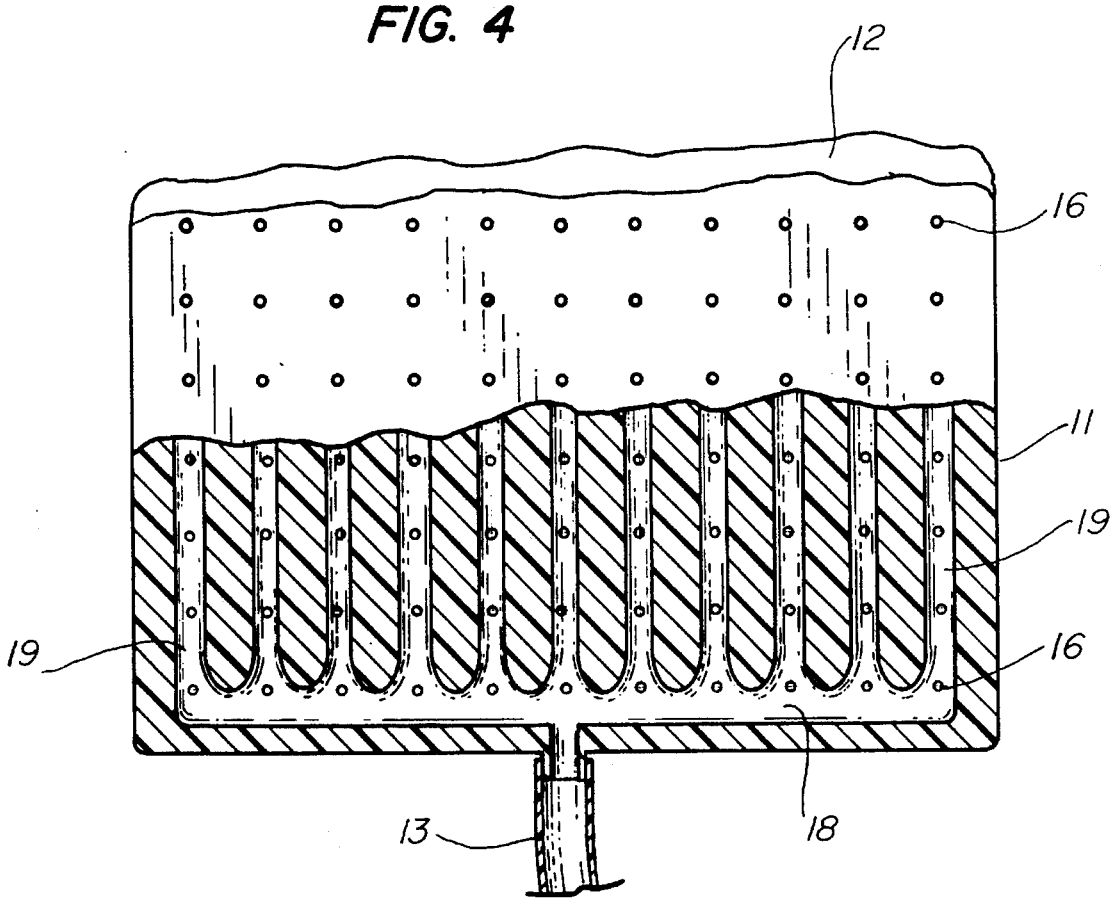
FIG. 4 is a partially sectioned top view of the pad of the present invention.

FIGS. 3 and 4 show in sectional views the interior configuration of pad 11. A distribution tubing 18 is shown in FIG. 4 connected to an air source via tube 13. Feeding off from and interconnecting to such distributer tubing 18 are a plurality of closed end air discharge tubings 19. A plurality of upwardly extending air vent openings or holes 16 are provided in each of the discharge tubings 19, extending upwardly through the plastic housing 20 of pad 11.

Utilizing this simple construction, the cost of the air percolating unit 10 is kept within the price range of an individual and the device can easily be removed for cleaning or transfer to another location.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved air percolating pad which is readily portable and adjustable for positioning under a bed-ridden patient which comprises: a small, thin, flexible plastic pad, the pad being formed in a generally rectangular configuration with long side edges and short side edges; a plurality of flexible, plastic tubes embedded within said pad; and means to conduct air through said tubes and to release it from said pad under a patient lying thereon, said pad being enclosed within a removable, sterile mesh fabric cover; said cover including a side slit and an open end which facilitates its quick and efficient placement and removal of the pad in an operative orientation;

said plurality of flexible plastic tubes including a main air distributor tube and a plurality of closed end air discharge tubes connected to and extending laterally from said distributor tube within said pad; and said means to conduct air through said tubes and to release it from said pad comprising a plurality of air vent openings extending upwardly from said plastic tubes and penetrating through the surface of said plastic pad; and a source of air pressure connected to said plastic tubes.

* * * * *